US006619501B2

(12) United States Patent
Hayes et al.

(10) Patent No.: US 6,619,501 B2
(45) Date of Patent: Sep. 16, 2003

(54) BASE FOR FOOD CONTAINERS

(75) Inventors: Thomas J. Hayes, McHenry, IL (US); James N. Gomoll, Lindenhurst, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/910,515

(22) Filed: Jul. 19, 2001

(65) Prior Publication Data

US 2003/0015539 A1 Jan. 23, 2003

(51) Int. Cl.[7] ..... B65D 1/44

(52) U.S. Cl. ..... 220/608; 220/675; 220/605; 220/606

(58) Field of Search ..... 220/608, 609, 220/675, 573.1, 574, 912, 915.1, 605, 606, 628, 670, 671

(56) References Cited

U.S. PATENT DOCUMENTS

| | | | | |
|---|---|---|---|---|
| 2,061,610 A | * | 11/1936 | Burnette | 126/390.1 |
| D177,360 S | | 4/1956 | Becker et al. | D44/1 |
| D195,699 S | | 7/1963 | Bostrom | D58/11 |
| 3,098,597 A | | 7/1963 | Johnson et al. | 229/2.5 |
| 3,104,776 A | | 9/1963 | Bostrom | 220/73 |
| D197,310 S | | 1/1964 | Butzko | D58/11 |
| D198,290 S | | 5/1964 | Miller, Jr. et al. | D58/12.6 |
| D198,545 S | | 6/1964 | Bostrom | D58/13 |
| 3,151,799 A | | 10/1964 | Engles, Jr. et al. | 229/2.5 |
| 3,253,762 A | | 5/1966 | Gaunt | 229/2.5 |
| 3,318,283 A | | 5/1967 | Maclam et al. | 118/500 |
| D209,605 S | | 12/1967 | Zoeller et al. | D44/1 |
| 3,563,445 A | | 2/1971 | Clayton | 229/25 |
| D226,775 S | | 4/1973 | Jones | D7/2 |
| D249,234 S | | 9/1978 | Limon et al. | D9/219 |
| D249,238 S | | 9/1978 | Limon et al. | D9/219 |
| 4,127,189 A | | 11/1978 | Shumrak et al. | 206/520 |
| D255,659 S | | 7/1980 | Dugan et al. | D9/219 |
| D270,703 S | | 9/1983 | El-Hag et al. | D7/357 |
| D273,181 S | | 3/1984 | Braddon | D9/425 |
| 4,442,969 A | | 4/1984 | Holden | 229/2.5 |
| 4,466,552 A | | 8/1984 | Butterworth et al. | 220/354 |
| D276,216 S | | 11/1984 | Michaud | D9/425 |
| D280,182 S | | 8/1985 | Tyler | D9/425 |
| 4,553,585 A | | 11/1985 | Pfleger et al. | 428/116 |
| D290,232 S | | 6/1987 | Holzkopf et al. | D9/424 |
| D298,791 S | | 12/1988 | Holzkopf | D7/83 |
| 4,863,058 A | * | 9/1989 | Antoni et al. | 215/321 |

(List continued on next page.)

FOREIGN PATENT DOCUMENTS

| | | |
|---|---|---|
| BE | 572074 | 11/1958 |
| DE | 8029894 | 5/1982 |
| JP | 05132059 | 5/1993 |
| NL | 1012752 | 12/2000 |

OTHER PUBLICATIONS

International Search Report for International Application No. PCT/US02/22882; dated Nov. 6, 2002; 7 pages.

Translation of Japanese Patent Abstract No. 05132059.

Translation of Netherlands Patent Abstract No. 1012752.

English Abstract of European Patent No. EP51868, which is related to German Patent No. 8029894.

Pactiv Advanced Packaging Solutions Catering Products Catalog; Nov., 2000; 12 pgs.

Tenneco Packaging Caterware Egg Insert product brochure; Jun., 1999; 2 pgs.

Pactiv Advanced Packaging Solutions, Specialty Product Specification Catalog; 2001; 180 pgs.

*Primary Examiner*—Stephen Castellano
(74) *Attorney, Agent, or Firm*—Jenkens & Gilchrist

(57) ABSTRACT

A base for a food container includes a pattern of rib units in a side wall of the container. The rib units are formed at multiple angles and depths to provide strength to the side wall. The base also includes a bottom with ribs of alternating heights and angles that provide strength to the bottom.

8 Claims, 8 Drawing Sheets

U.S. PATENT DOCUMENTS

| | | | | | |
|---|---|---|---|---|---|
| 4,874,083 | A | | 10/1989 | Antoni et al. | 206/45 |
| D304,909 | S | | 12/1989 | Natori | D9/423 |
| D305,409 | S | | 1/1990 | Michaud et al. | D9/425 |
| 4,994,638 | A | | 2/1991 | Iorns et al. | 219/10.55 |
| 5,046,659 | A | | 9/1991 | Warburton | 229/2.5 |
| 5,094,355 | A | | 3/1992 | Clark et al. | 220/4.23 |
| 5,131,551 | A | | 7/1992 | Wells | 220/4.23 |
| D341,316 | S | | 11/1993 | Fritz et al. | D9/429 |
| 5,269,430 | A | | 12/1993 | Schlaupitz et al. | 220/4.23 |
| D343,576 | S | | 1/1994 | Krupa | D9/423 |
| D345,894 | S | | 4/1994 | Krupa | D7/552 |
| D345,912 | S | | 4/1994 | Krupa | D9/429 |
| 5,322,182 | A | | 6/1994 | Fritz | 220/623 |
| D348,608 | S | | 7/1994 | Wyslotsky | D9/425 |
| D351,999 | S | | 11/1994 | Krupa | D9/423 |
| D352,000 | S | | 11/1994 | Hansen et al. | D9/429 |
| 5,381,901 | A | * | 1/1995 | Hundley | 206/457 |
| D358,091 | S | | 5/1995 | Warburton | D9/429 |
| 5,423,453 | A | | 6/1995 | Fritz | 220/608 |
| 5,441,166 | A | | 8/1995 | Lucas, Jr. et al. | 220/306 |
| 5,456,379 | A | | 10/1995 | Krupa et al. | 220/339 |
| 5,471,718 | A | | 12/1995 | Harrill | 27/7 |
| 5,515,993 | A | | 5/1996 | McManus | 220/339 |
| D374,376 | S | | 10/1996 | Goins et al. | D7/392.1 |
| 5,577,627 | A | | 11/1996 | Richie-Dubler | 220/4.23 |
| 5,628,427 | A | | 5/1997 | Hayes | 220/669 |
| D382,796 | S | | 8/1997 | Mangola | D9/429 |
| 5,662,237 | A | | 9/1997 | Cain | 220/368 |
| 5,685,453 | A | | 11/1997 | Goins et al. | 220/782 |
| D391,850 | S | | 3/1998 | Krupa et al. | D9/429 |
| D392,881 | S | | 3/1998 | Bulcher et al. | D9/425 |
| D392,884 | S | | 3/1998 | Hayes | D9/431 |
| 5,730,313 | A | | 3/1998 | Hayes et al. | 220/526 |
| D393,204 | S | | 4/1998 | Goins et al. | D9/425 |
| D415,025 | S | | 10/1999 | McCann | D9/429 |
| D429,961 | S | | 8/2000 | Harris | D7/540 |
| D458,538 | S | | 6/2002 | Hayes et al. | D9/434 |
| D461,123 | S | | 8/2002 | Hayes et al. | D9/429 |

* cited by examiner

BASE FOR FOOD CONTAINERS

FIELD OF THE INVENTION

The present invention relates to food containers and, more particularly, to an array of ribs of multiple depths and angles in the side wall and bottom of a rigid plastic food container to reinforce the food container.

BACKGROUND OF THE INVENTION

A container often used with hot foods such as roasted or broiled whole chicken has a lid and base thermoformed from plastic material. When this container is heated by the cooked food, and/or Hot case, the plastic of the container base can get soft and bend along a transverse line in reaction to the weight of the chicken when the base is grasped at one end and lifted. Ribs are formed in the base to reinforce the base but the rib patterns alone do not provide sufficient reinforcement and a thicker material for the base is often required. This increases the cost of the container. It is desirable to provide a rib array or pattern for the base of these containers that provides sufficient reinforcement to allow a thinner material to be used in thermoforming the base.

SUMMARY OF THE INVENTION

The present invention provides a pattern or array of ribs in a side wall and bottom of a thermoformed plastic container base that resists bending of the base when it is warm or cold and filled with food. The pattern includes a plurality of rib units formed in the side wall. The rib units provide multiple depths and multiple angles such that there is no straight path for bending.

In addition, a plurality of ribs are formed in the bottom of the base. The ribs are of different heights and angles relative to each other and the different heights and angles are alternated. This array or pattern prevents the formation of a straight bend line through the bottom of the base reducing the likelihood of bending under a load. This array includes longitudinal ribs extending the length of the bottom to create a beam that inhibits bending of the bottom when the base is picked up at an end of the base.

BRIEF DESCRIPTION OF THE DRAWINGS

Other objects and advantages of the invention will become apparent upon reading the following detailed description in conjunction with the drawings in which.

Figure 1:
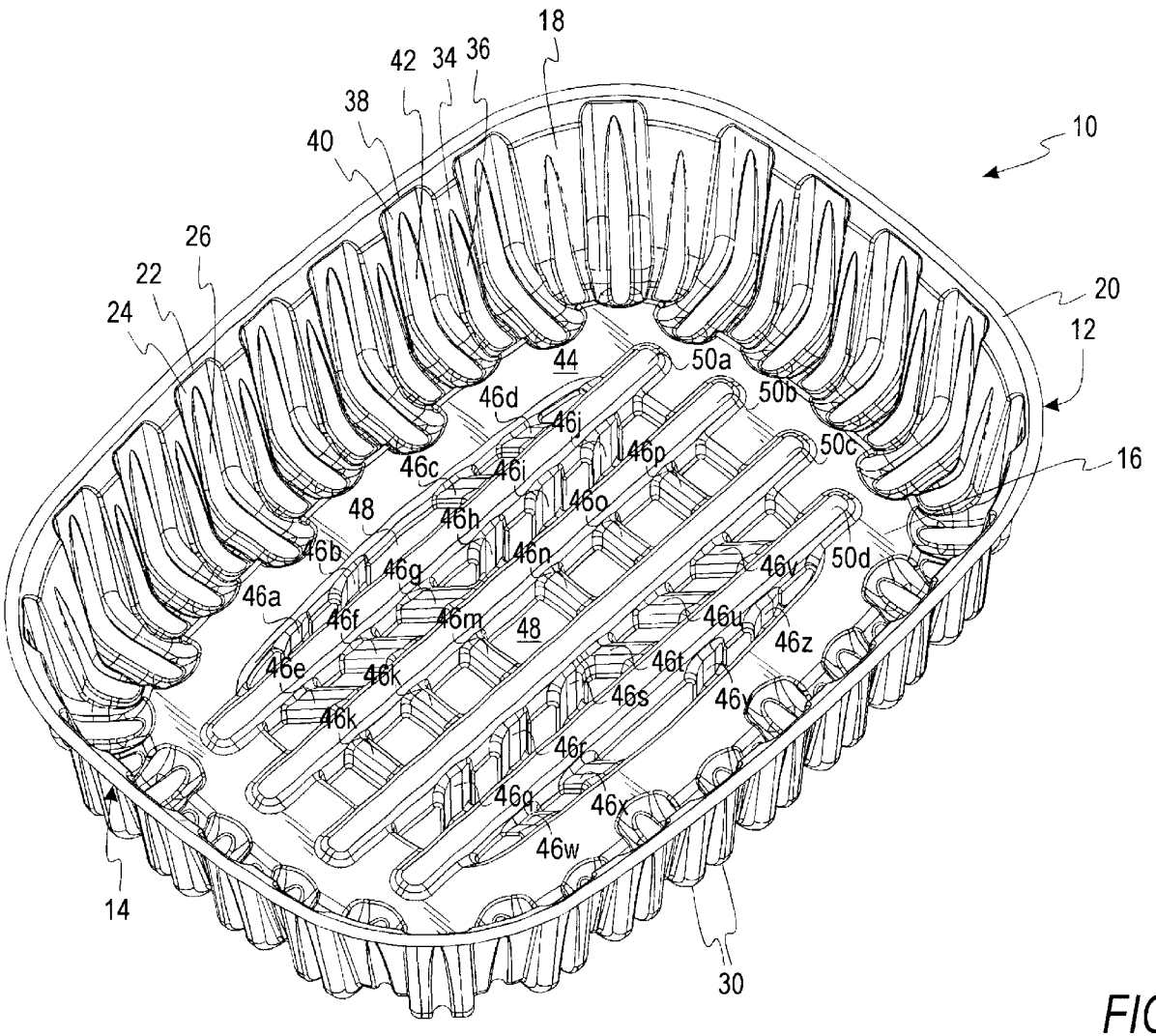
FIG. 1 is a perspective view of a base for food containers constructed in accordance with the principles of the present invention.
Figure 2:
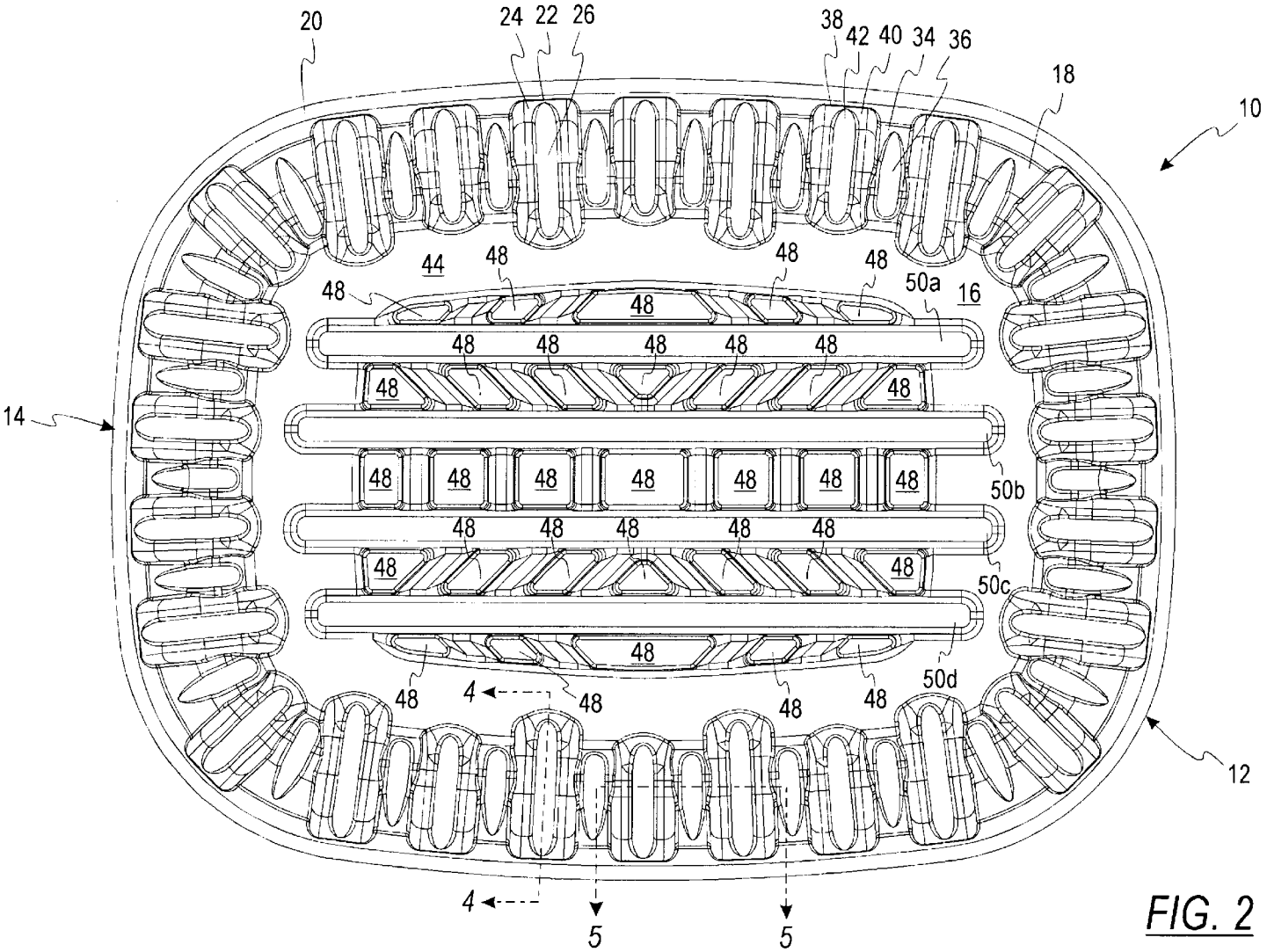
FIG. 2 is a top plan view of the base of the present invention.
Figure 3:
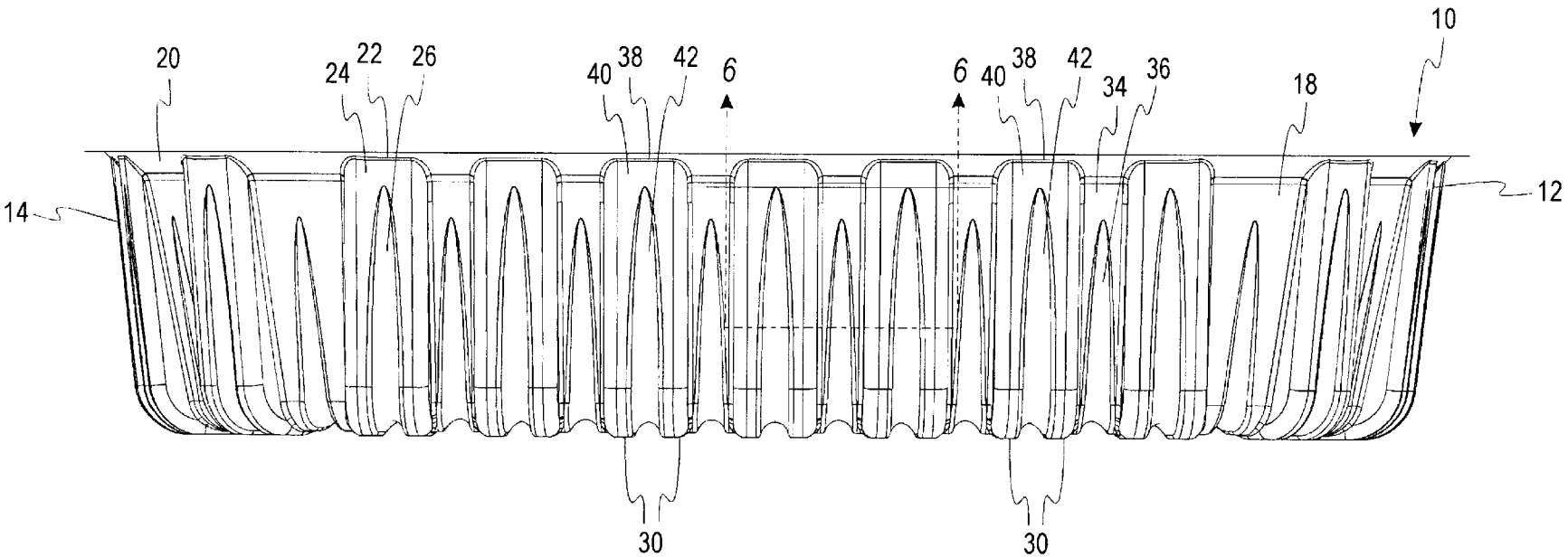
FIG. 3 is a side elevational view of the base of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE PREFERRED EMBODIMENTS

Referring initially to FIGS. 1–6, there is illustrated a base 10 for a food container. The base 10 includes a bottom 16 and a side wall 18 that extends around the entire periphery of the the bottom 16 and extends from the bottom 16 to a rim 20. The base 10 can be thermoformed plastic and can be covered with a lid if desired. The base 10 is intended to carry foods and preferably hot food such as rotisserie chicken. The elevated temperature of the food and/or Hot case will heat and soften the plastic making the base 10 more prone to bending when lifted or carried by gripping a first end 12 or a second end 14 or the corners of the base 10. Since this bending is undesirable because food and/or juices can be spilled, the base 10 is strengthened to avoid bending by including a pattern or array of ribs and rib units of multiple angles and multiple depths such that the base 10 does not have a straight path of bending.

The side wall 18 includes an array or pattern of one or more rib units that provide multiple angles and depths to the side wall 18. A first rib unit 22 is thermoformed into the side wall 18 and includes a first female rib 24 and a first male rib 26 formed in the female rib 24. The first female rib 24 extends from adjacent the rim 20 into the bottom 16. The first male rib 26 is shorter than the first female rib 24 and extends from near the rim 20 into the bottom 16.

The first rib unit 22 strengthens the side wall 18 against bending by providing multiple depths. The rounded surfaces or knuckles 30 (FIG. 3) formed between the first male rib 26 and first female rib 24 results from the different widths of the first male rib 26 and the first female rib 24. The knuckles 30 also strengthen base 10 against vertical or crushing forces.

Figure 4:
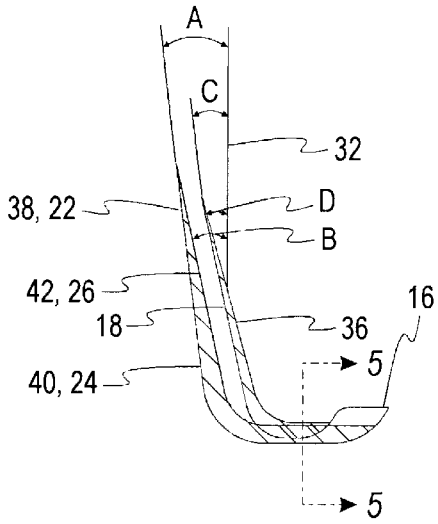
FIG. 4 is a view taken along line 4—4 in FIG. 2.
Figure 5:
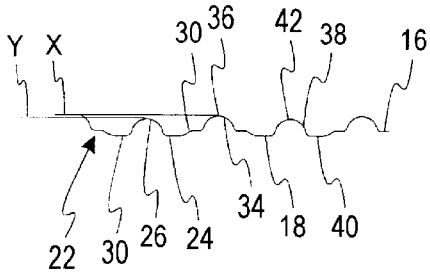
FIG. 5 is a view taken along line 5—5 in FIGS. 2 and 4.
Figure 6:
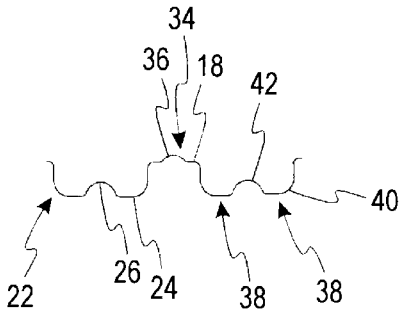
FIG. 6 is a view taken along line 6—6 in FIG. 3.
Figure 7:
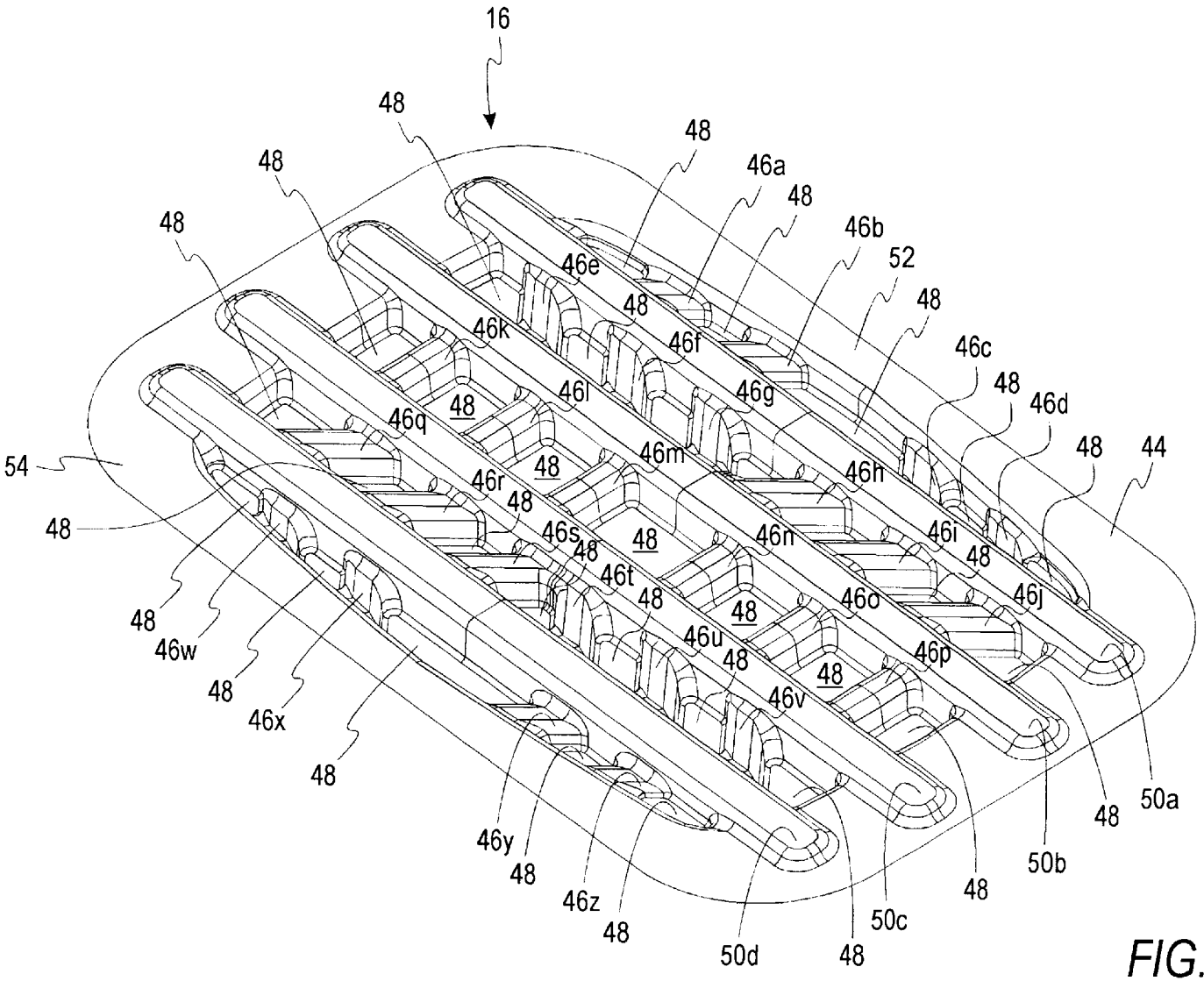
FIG. 7 is a perspective view of the bottom of the base of the present invention.
Figure 8:
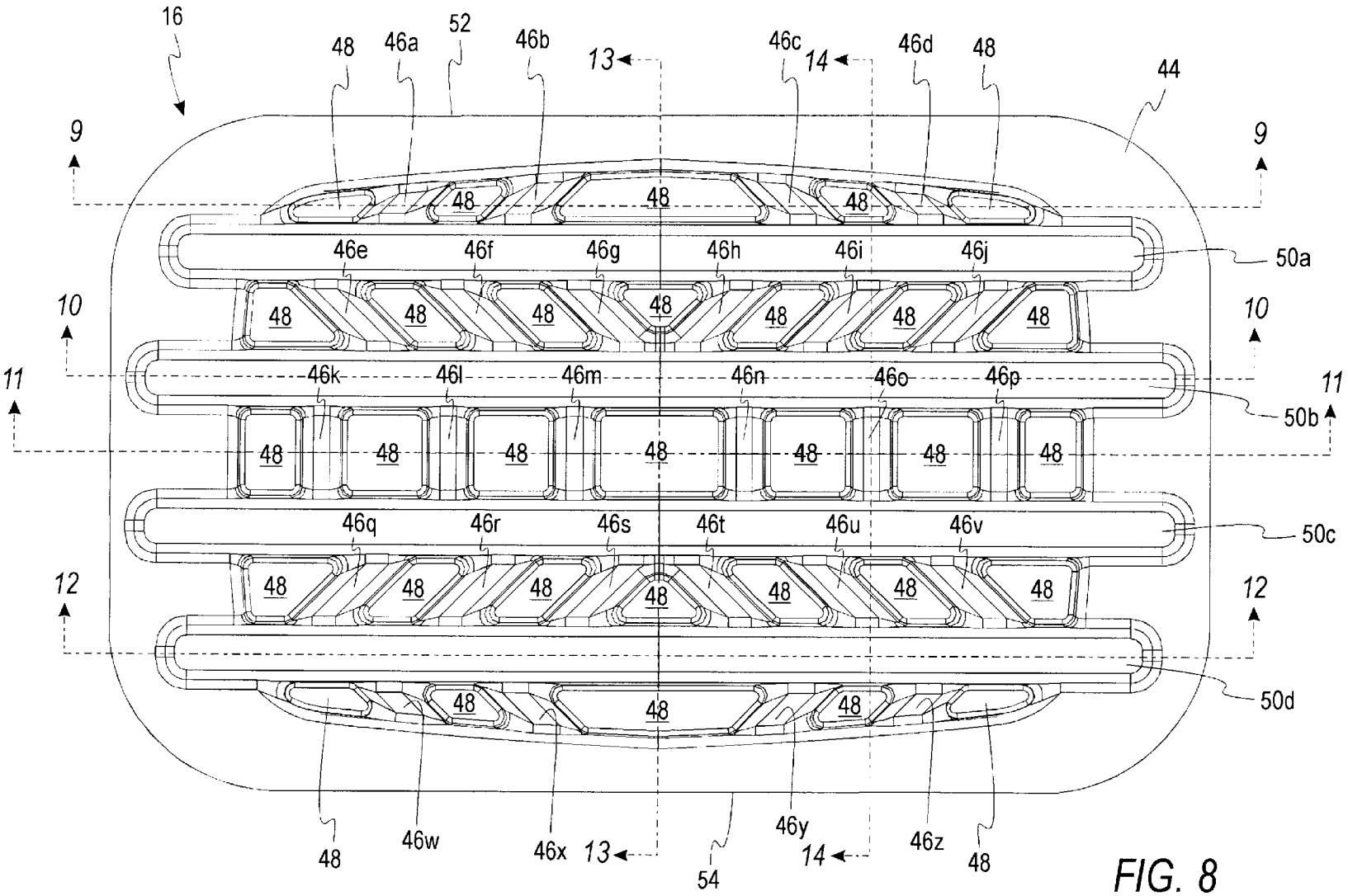
FIG. 8 is a top plan view of the bottom.
Figure 9:
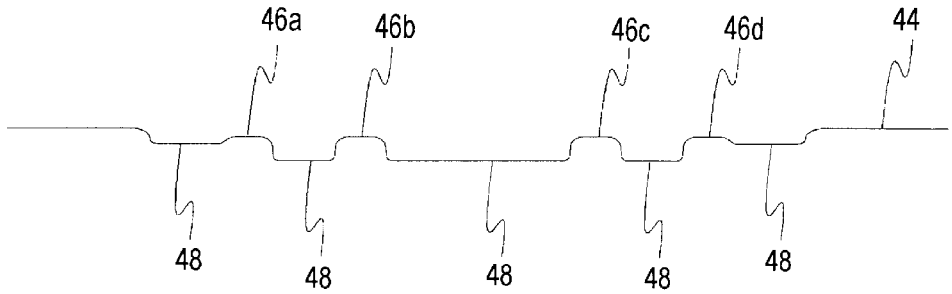
FIG. 9 is a view taken along line 9—9 of FIG. 8.
Figure 10:
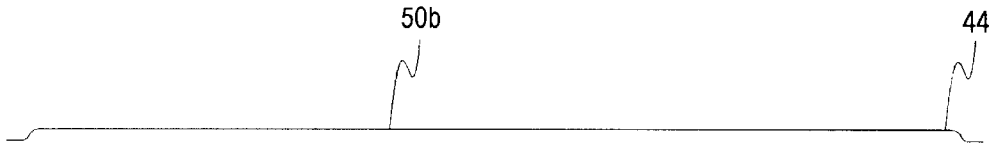
FIG. 10 is a view taken along line 10—10 of FIG. 8.
Figure 11:
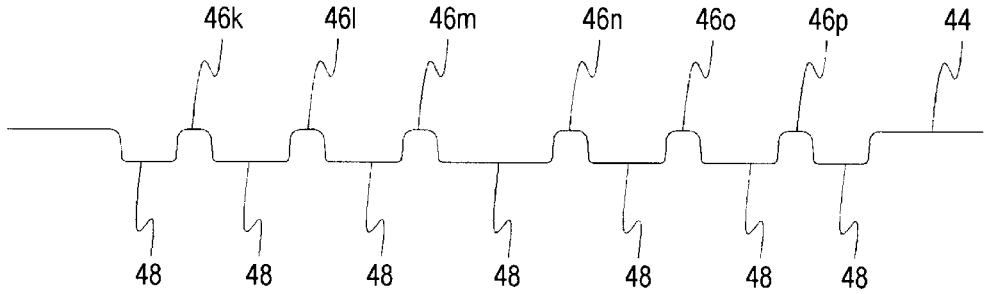
FIG. 11 is a view taken along line 11—11 of FIG. 8.
Figure 12:
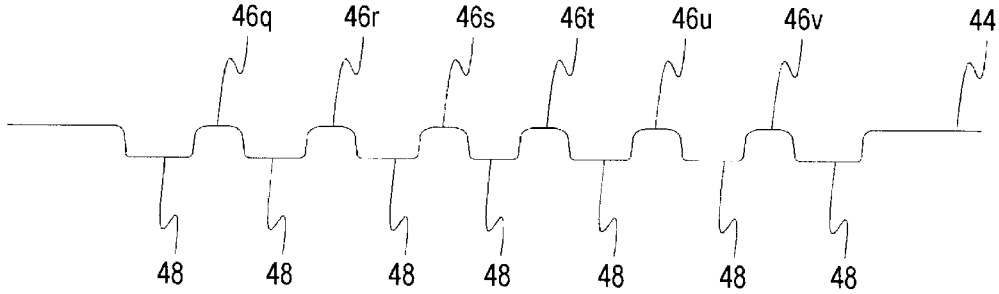
FIG. 12 is a view taken along line 12—12 of FIG. 8.
Figure 13:
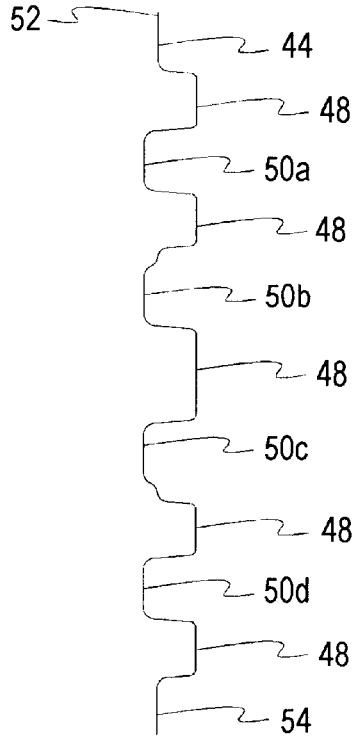
FIG. 13 is a view taken along line 13—13 of FIG. 8.
Figure 14:
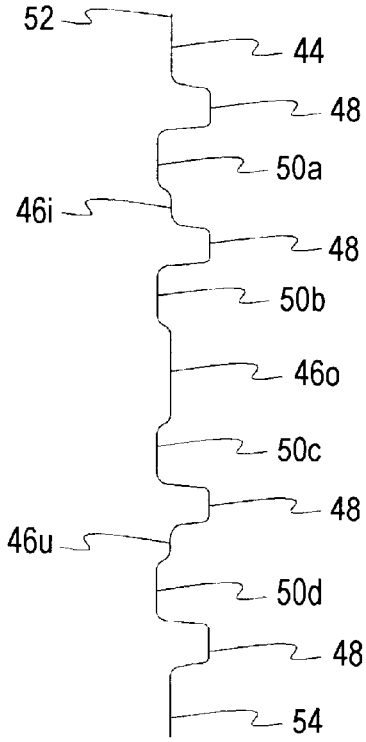
FIG. 14 is a view taken along line 14—14 of FIG. 7.

The first rib unit 22 also strengthens the side wall 18 against bending by providing multiple angles. The first female rib 24 is at an angle A to a vertical line 32 that is perpendicular to the bottom 16 (FIG. 4). The angle of the first male rib 26 to the vertical line 32 is B. The range for the angle A is from about 5° to about 44° and the range for the angle B is from about 6° to about 45°. Although the angles A and B can be equal, in a preferred embodiment the angle B is larger than angle A. The different angles A and B add to the strengthening effect of the first rib unit 22 and contribute to avoiding a straight line of bending in the base 10. The first rib unit 22 can be repeated around the entire side wall 18 to form a pattern or array. The array or pattern can be the first rib unit 22 positioned adjacent to each other or spaced apart with portions of the side wall 18 between rib units 22.

Additional depths and angles can be provided in the side wall 18 by a second rib unit 34 thermoformed in the side wall 18. The second rib unit 34 includes a second male rib 36. The second male rib 36 is shorter than the first male rib 26 and does not extend as far toward the rim 20 or into the bottom 16 as the first male rib 26. To provide additional angles the side wall 18 is at an angle C to the vertical line 32 (FIG. 4). Angle C is from about 5° to about 44°. The second male rib 36 is at an angle D to the vertical line 32 which is from about 6° to about 45°. Although the angle D of the second male rib can be at any angle in the range mentioned, it is preferred that the angle D of the second male rib 36 be different than the angle B of the first male rib 26. In addition, the depth X (FIG. 5) of the second male rib 36 is greater than the depth Y of the first male rib 26 contributing to the multiple depth characteristic of a rib array or pattern that includes both the first rib unit 22 and the second rib unit 34. A multiple angle, multiple depth rib array or pattern may include alternating the first rib unit 22 and the second rib unit 34 or may include any combination of multiple first rib units 22 interspaced by one or several second rib units 34.

To provide additional depths and angles to the array or pattern of ribs in the side wall a third rib unit 38 may be thermoformed into the side wall 18. The third rib unit 38 includes a second female rib 40 and a third male rib 42 formed in the female rib 40. The angle of the second female rib 40 to a vertical line 32 can be in the range from about 5° to about 44° and the angle of the third male rib 42 to a vertical line is in the range of from about 6° to about 45°. Although the angle of the second female rib 40 and the third male rib 42 can be the same, it is preferred that the angle of the third male rib 42 be greater than the angle of the second female rib 40.

The third rib unit 38 strengthens the side wall 18 against bending by providing multiple depths. The rounded surfaces or knuckles 30 (FIG. 3) formed between the third male rib 42 and the second female rib 40 results from the different widths of the third male rib 42 and the second female rib 40.

The second female rib 40 extends upwardly higher toward the rim 20 than does the third male rib 42. The first female rib 24 and the second female rib 40 are at the same height relative to the rim 20 as are the first male rib 26 and the third male rib 42. The second male rib 36 is shorter than the first male rib 26 and the third male rib 42. The second female rib 40 extends into the bottom 16 farther than the third male rib 42 but not as far as the first female rib 24. The third male rib 42 extends into the bottom 16 farther than the second male rib 36 but not as far as the first male rib 26. These different multiple extensions into the bottom 16 and the multiple heights relative to the rim 20 also add strength to the base 10 by preventing a straight bend line in the base 10.

Turning now to FIGS. 7–13, the bottom 16 of the base 10 is shown in more detail. The bottom 16 includes four different levels and alternating patterns of ribs perpendicular to the X and Y axis of the bottom 16 and angled relative to the X and Y axis. The pattern or array of alternating levels and angles prevents bending of the bottom 16 along the X or Y axis. The bottom 16 with its pattern or array of ribs combined with the side wall 18 with its pattern or array of ribs provides an increase in strength of the base 10 when supported or held at the first end 12 or second end 14 or at the corners while a force is loaded at the end opposite the end being held.

The bottom 16 includes a bottom wall 44 which defines one of four different levels or heights in the bottom 16. A second level or height is defined by a plurality of first or shallow ribs 46A–46Z formed in the bottom 16. A third level is provided by a plurality of depressions 48 formed in the bottom wall 44 and between the first or shallow ribs 46. A fourth level is defined by second or higher ribs 50A–50D. The four different levels as defined by the bottom wall 44, first, shallow ribs 46A–46Z, depressions 48, and second, higher ribs 50A–50D are alternated such that a straight line from a first side 52 of the bottom 16 to a second side 54 will pass through alternating levels as opposed to only one level.

In addition to alternating levels or elevations, the bottom 16 also has ribs at alternating angles. The second or higher ribs 50A–50D are horizontal and extend along the longitudinal axis of the bottom wall 44. These ribs 50A–50D also define beams extending along the length of the bottom wall 44 to provide beam strength to the bottom 16 of the base 10. Some of the first or shallow ribs 46K–46P are perpendicular to the second or higher ribs 50B and 50C while a first set of the first shallow ribs 46C–46G, 46T–46X are on an angle greater than about 0° and less than about 90° to the second higher ribs 50A–50D and a second set of first shallow ribs 46A, 46B, 46H–46J, 46Q–46S, 46Y and 46Z are at an angle (i.e., greater than about 180° and less than about 270°) opposite the angle of the first set of first shallow ribs. These alternating angles of the ribs are formed such that a straight line extending through the bottom 16 from the first side 52 to the second side 54 intersects alternating angles. The alternating levels and angles inhibit bending of the base 10 along a straight line when the base 10 is held at the first end 12 or second end 14 while a load is in the base 10 thereby providing strength to the base 10 in addition to the increased strength provided by the array or pattern of ribs in the side wall 18.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A base for a food container, comprising:

a bottom having a periphery, the bottom including a bottom wall, a plurality of depressions in said bottom wall, said depressions extending below said bottom wall, a plurality of first ribs formed in said bottom wall and extending to a first elevation, at least one of the plurality of first ribs being disposed substantially perpendicular to a longitudinal axis of the bottom wall, a plurality of second ribs formed in said bottom wall and extending to a second elevation, the plurality of second ribs being disposed substantially parallel to the longitudinal axis of the bottom wall; and a side wall extending around the periphery of the bottom wall, the side wall defining an interior of the base, the side wall including a plurality of first rib units formed in the side wall upwardly extending from the bottom wall, each of the plurality of first rib units including a first outward projection extending away from the interior and a first inward projection extending towards the interior, the first inward projection being formed within the first outward projection, a plurality of second rib units formed in the side wall upwardly extending from the bottom wall, each of the plurality of second rib units being disposed adjacent one of the plurality of first rib units, each of the plurality of second rib units including a second inward projection extending towards the interior, the second inward projection being shorter than the first inward projection, and a plurality of third rib units formed in the side wall upwardly extending from the bottom wall, each of the plurality of third rib units being positioned adjacent one of the plurality of second rib units, each of the plurality of third rib units including a second outward projection extending away from the interior and a third inward projection extending towards the interior, the third inward projection being formed within the second outward projection, the second outward projection being shorter than the first outward projection.

2. The base for a food container of claim 1 wherein the first outward projection has an end extending into the bottom wall.

3. The base for a food container of claim 1 wherein the first outward projection extends into the bottom wall.

4. The base for a food container of claim 1 wherein the second outward projection extends into the bottom wall.

5. The base for a food container of claim 1 wherein the first inward projection extends into the bottom wall.

6. The base for a food container of claim 1 wherein the second inward projection extends into the bottom wall.

7. The base for a food container of claim 1 wherein the third inward projection extends into the bottom wall.

8. The base of a food container of claim 1 wherein one or more of the plurality of first ribs formed in said bottom wall are disposed at a first angle relative to the a longitudinal axis of the bottom wall, and wherein one or more of the plurality of first ribs formed in said bottom wall are disposed at a second angle relative to the a longitudinal axis of the bottom wall, the first angle being different that the second angle.

* * * * *